US005934035A

United States Patent [19]

Rasmussen et al.

[11] Patent Number: 5,934,035

[45] Date of Patent: Aug. 10, 1999

[54] MODULAR PILLAR

[75] Inventors: Finn A. Rasmussen; Bo A. Rasmussen, both of Kelowna, Canada

[73] Assignee: Anker Brick Pillars Ltd., Calgary, Canada

[21] Appl. No.: 08/926,157

[22] Filed: Sep. 9, 1997

Related U.S. Application Data

[60] Provisional application No. 60/025,479, Sep. 9, 1996.

[51] Int. Cl.[6] ..... E04H 12/28

[52] U.S. Cl. ..... 52/300; 52/314; 52/592.6; 52/604; 52/606; 52/612; 52/722.1; 52/723.1; 52/726.5; 52/745.18; 52/745.2; 52/747.12; 29/897.33; 256/19

[58] Field of Search ..... 52/314, 592.6, 52/300, 604, 606, 612, 722.1, 723.1, 726.5, 745.03, 745.18, 745.2, 747.12; 29/897.33; 256/19

[56] References Cited

U.S. PATENT DOCUMENTS

| | | | |
|---|---|---|---|
| 3,590,547 | 7/1971 | Molyneux et al. . | |
| 4,686,807 | 8/1987 | Newsome | 52/314 |
| 4,811,534 | 3/1989 | Newsome | 52/314 X |
| 5,335,471 | 8/1994 | Kupiec . | |
| 5,361,977 | 11/1994 | Ogrodnick, Jr. | 52/314 X |
| 5,568,709 | 10/1996 | Steckler . | |
| 5,605,023 | 2/1997 | Biernazki . | |
| 5,623,797 | 4/1997 | Gravier et al. | 52/604 X |
| 5,761,861 | 6/1998 | Brackett | 52/314 X |

FOREIGN PATENT DOCUMENTS

| | | |
|---|---|---|
| 1272389 | 8/1990 | Canada . |
| 1300920 | 5/1992 | Canada . |
| 2106545 | 3/1995 | Canada . |
| 2143234 | 7/1996 | Canada . |
| 0030510 | 6/1981 | European Pat. Off. . |
| 337378 A1 | 10/1989 | European Pat. Off. . |

*Primary Examiner*—Christopher Kent
*Attorney, Agent, or Firm*—Antony C. Edwards

[57] ABSTRACT

The modular pillar is assembled by overlaying precast brick layers, one on top of the other to form a pillar of such layers. Each layer has a depression, groove, channel, cut-out, or the like, of recessing one of its horizontal surfaces for interlocking mating with a corresponding elevation or protrusion on the adjacent horizontal surface of the next adjacent layer.

9 Claims, 8 Drawing Sheets

MODULAR PILLAR

CROSS REFERENCE TO RELATED APPLICATION

This application claims priority from U.S. Provisional Application 60/026,479, filed Sep. 9, 1996, titled Modular Pillar.

FIELD OF THE INVENTION

This invention relates to the field of modular systems for building columnar structures, and in particular, modular components for building pillars.

BACKGROUND OF THE INVENTION

In the past, if it was desired to build a pillar so as to, for example, support fence panels, gates or the like, and if it was desired that the pillar be of brick construction, a bricklayer was required to build the pillar in the same fashion as the bricklayer would build any other brick structure, namely, using bricks, mortar and a considerable amount of skill.

Applicant is, however, aware of an attempt in the prior art to simulate the look of brick pillars by the use of modular building blocks which may be assembled vertically to form a pillar, where the blocks have a circumferential surface made to simulate the appearance of bricks and mortar. In particular, Applicant is aware of European patent 030,510 A2 to Servant which teaches a modular system for building walls or pillars using hollow blocks of terra cotta. What is disclosed for building a pillar is a block which is, in cross section, a hollow rectangle having grooves formed on the outer faces of the block to give the appearance of individual bricks laid in a conventional manner. A number of such blocks are placed one upon another in careful alignment and the hollow center of the blocks then filled with cement or concrete to bond the blocks together. What is neither taught nor suggested, and which it is an object of the present invention to provide, is interlocking adjacent blocks in the pillar structure so that the blocks do not have to be carefully aligned with one another because the means of interlocking takes care of such alignment. The means of interlocking also alleviates the requirement that the hollow center of the blocks be filled with cement or concrete, so that filling the hollow center is optional in the present invention.

Applicant is also aware of Canadian patent application 2,106,545 to MacDonell which teaches a simulated masonry column having the exterior appearance of masonry constructed by means of exterior siding mounted onto a wooden frame. Again, the interlocking modular blocks of the present invention are neither taught nor suggested.

SUMMARY OF THE INVENTION

It is an object of the present invention to provide a modular pillar having the exterior appearance of masonry, that is, of a brick and mortar finish, which may be quickly assembled to duplicate the craftsmanship of a bricklayers construction at a fraction of the cost. The modular pillar of the present invention is assembled by overlaying precast brick layers, one on top of the other to form a pillar of such layers. Each layer has a depression, groove, channel, cut-out, or like means of recessing one of its horizontal surfaces for interlocking mating with a corresponding elevation or protrusion on the adjacent horizontal surface of the next adjacent layer.

In a preferred embodiment, a first modular layer is fitted onto a precast base, which may be made of concrete.

Consecutive layers are laid sequentially onto the first modular layer by placing, in succession, the modular precast brick layers one on top of the other. Advantageously, for saving in weight, each block is hollow so that, once assembled, a cavity runs continuously from the base of the pillar to the top of the pillar. Thus, if wiring is required in the pillar to facilitate, for example, a light fixture placed on top of the pillar, such wiring can be run up through the cavity.

In a preferred embodiment, a pipe such as a PVC pipe may be placed into the cavity to provide a wiring conduit, and the pipe held in place by filler, such as cement or concrete, poured or packed into the remaining void between the pipe and the interior walls of the cavity. It is to be emphasized that such filler is not required to hold the adjacent brick layers in place, as that function is accomplished by the interlocking of adjacent layers.

A concrete cap may be placed over the uppermost brick layer in the pillar and may be adorned by a light or other fixture.

The brick layers are preassembled by moulding, as for example casting of concrete, which may be colorized on the exterior surface, or by other moulding or assembly means such as cementing a layer of bricks within a form. It is within the scope of the invention that each layer be cast as a block or slab in such a fashion so as to, firstly, simulate the appearance of brick and mortar on the exterior surface and so as to, secondly, result in a block of solid construction, with the exception of a central cavity extending between corresponding apertures on upper and lower opposite generally horizontal surfaces on the block or slab. In one preferred embodiment, the precast brick layer is made of conventional clay bricks, bonded together by mortar, where the mortar may also be formed into an elevated or raised surface on one horizontal surface, and formed into a corresponding sized depression in the opposite horizontal surface so as to provide the interlocking means between each precast brick layer.

Where it is desired to use the modular pillar of the present invention as a fence post, mounting brackets are formed into the brick layer so as to leave mounting flanges or the like protruding from opposite sides of the modified brick layer. The modified layers are then placed at the appropriate height as the modular pillar is being assembled so that the flanges may be used to support the fence panels or fence supporting members.

In summary, the modular pillar of the present invention has a base module having an upper generally planar surface for receiving in interlocking engagement thereon a simulated brick layer, a plurality of the simulated brick layers stackable on top of each other in a vertically adjacent array, a lowermost simulated brick layer of the plurality of the simulated brick layers stackable in the interlocking engagement on the upper generally planar surface of the base module, and a cap module stackable on top of an uppermost simulated brick layer of the plurality of the simulated brick layers.

Advantageously, each of the simulated brick layers has an outer surface having an outer circumferentially contiguous array of brick surfaces extending in a horizontal plane so as to expose radially outwardly of the simulated brick layer at least one face of the brick surfaces to thereby form a circumferentially contiguously extending brick and mortar surface in the horizontal plane around the outer surface of the simulated brick layer.

Further advantageously, when the plurality of the simulated brick layers stackable on top of each other in the vertically adjacent array are so stacked, the horizontal planes of each of the simulated brick layers are parallel.

Further advantageously, each of the simulated brick layers define therein a vertically extending cavity extending between an aperture in a lower surface of each of the simulated brick layers and an upper surface of each of the simulated brick layers so as to define a generally vertical columnar cavity extending from the base module to the cap module when the plurality of the simulated brick layers are stacked in the vertically adjacent array.

Further advantageously, the simulated brick layers include interlocking means for interlocking the upper surfaces and the lower surfaces on adjacent simulated brick layers in a plurality of simulated brick layers.

Further advantageously, the interlocking means includes an elevated surface on the upper surfaces and a correspondingly sized depression in the lower surfaces for snug mating of the elevated surface into the depression when the simulated brick layers are stacked into the vertically adjacent array.

Further advantageously, the interlocking means also includes an elevated surface on the lower surfaces and a correspondingly sized depression in the upper surfaces for snug mating of the elevated surface into the depression when the simulated brick layers are stacked into the vertically adjacent array.

The method of making a modular pillar includes the steps of (a) forming each layer of the simulated brick layers by (i) spacing a plurality of bricks in spaced circumferential array around an interior circumference of a form, (ii) filling spacing between the spaced array with solidifiable filler, (iii) forming from the solidifiable filler on opposite horizontal surfaces of each of the layers an elevated surface and a correspondingly sized depression respectively corresponding in size to the elevated surface; (b) stacking successive layers of the simulated brick layers onto the base module into the vertically adjacent array so as to interlock adjacent layers by interlocking the interlocking means; and (c) stacking the cap module onto the uppermost simulated brick layer.

Advantageously, a rigid electrical conduit is journalled along the length of the cavity for electrical communication of a power supply to an electrical fixture mounted to the modular pillar. Further advantageously, the cavity is filled with solidifiable filler so as to rigidly mount the electrical conduit in the cavity. Caulking may be applied between adjacent the simulated brick layers. Fence attaching means may be mounted to at least one of the simulated brick layers.

DETAILED DESCRIPTION OF THE PREFERRED EMBODIMENT

Figure 1:
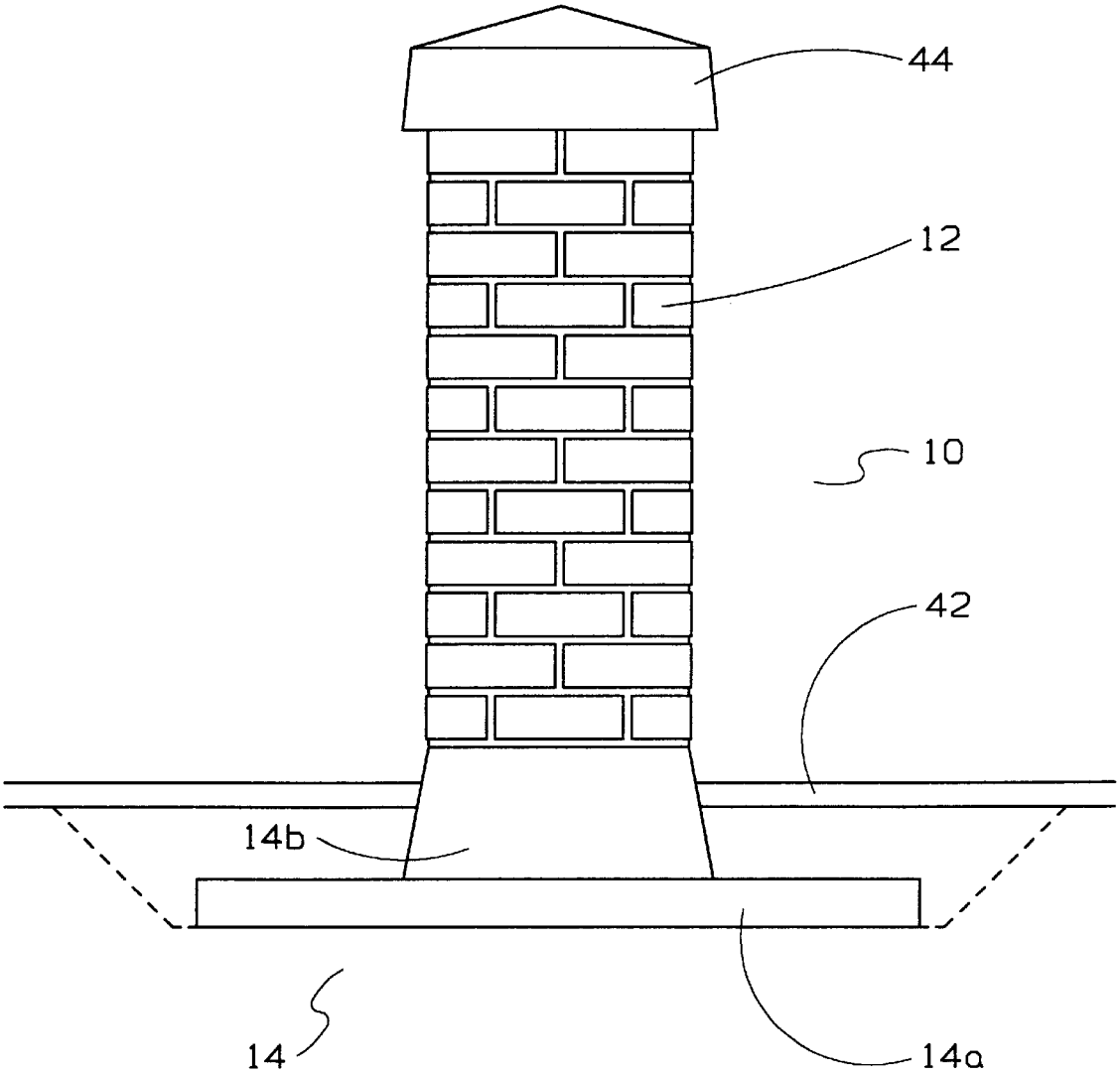
FIG. 1 is, in side elevation view, the modular pillar of the present invention.
Figure 2:
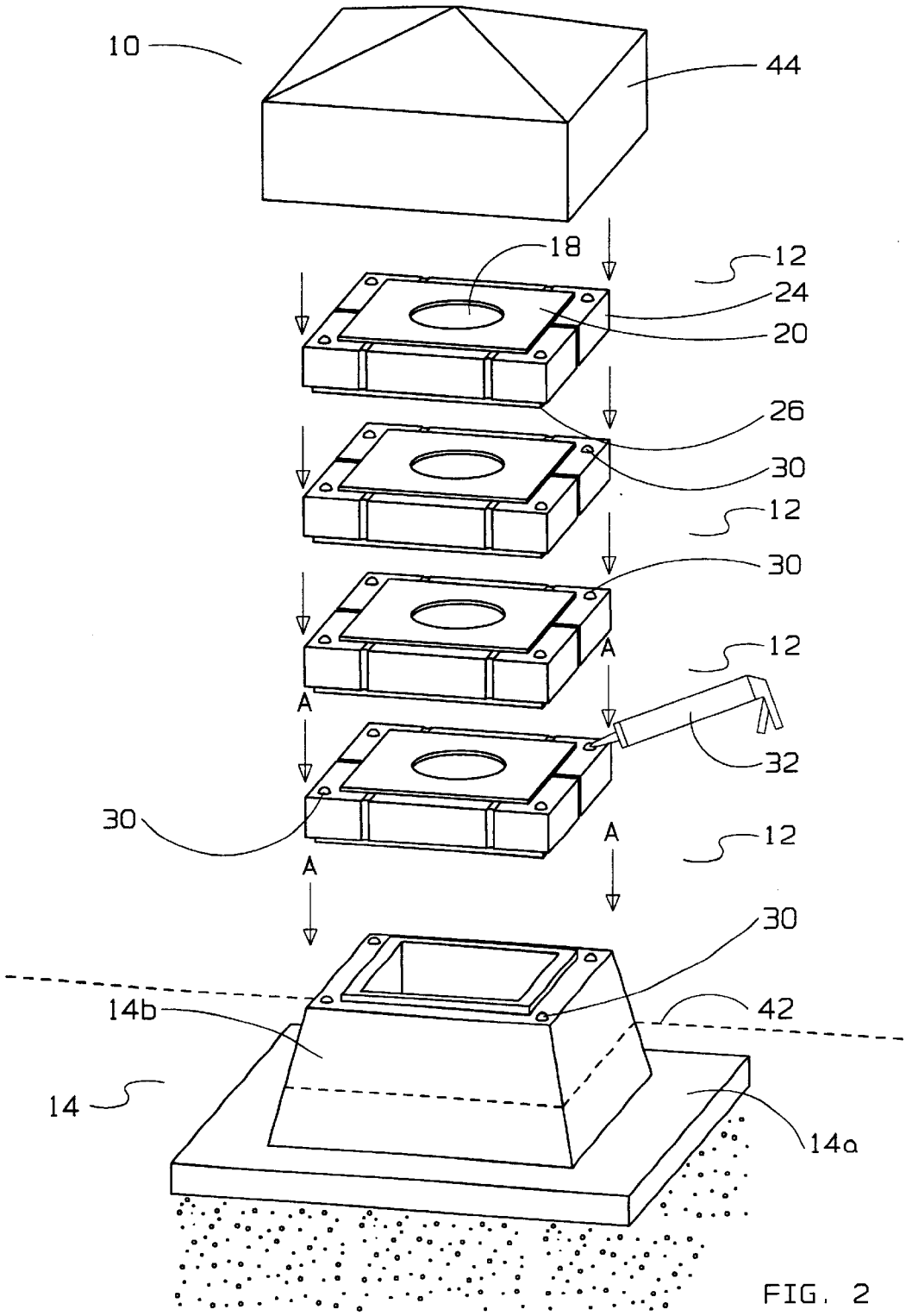
FIG. 2 is, in exploded view, the modular pillar of FIG. 1.
Figure 3:
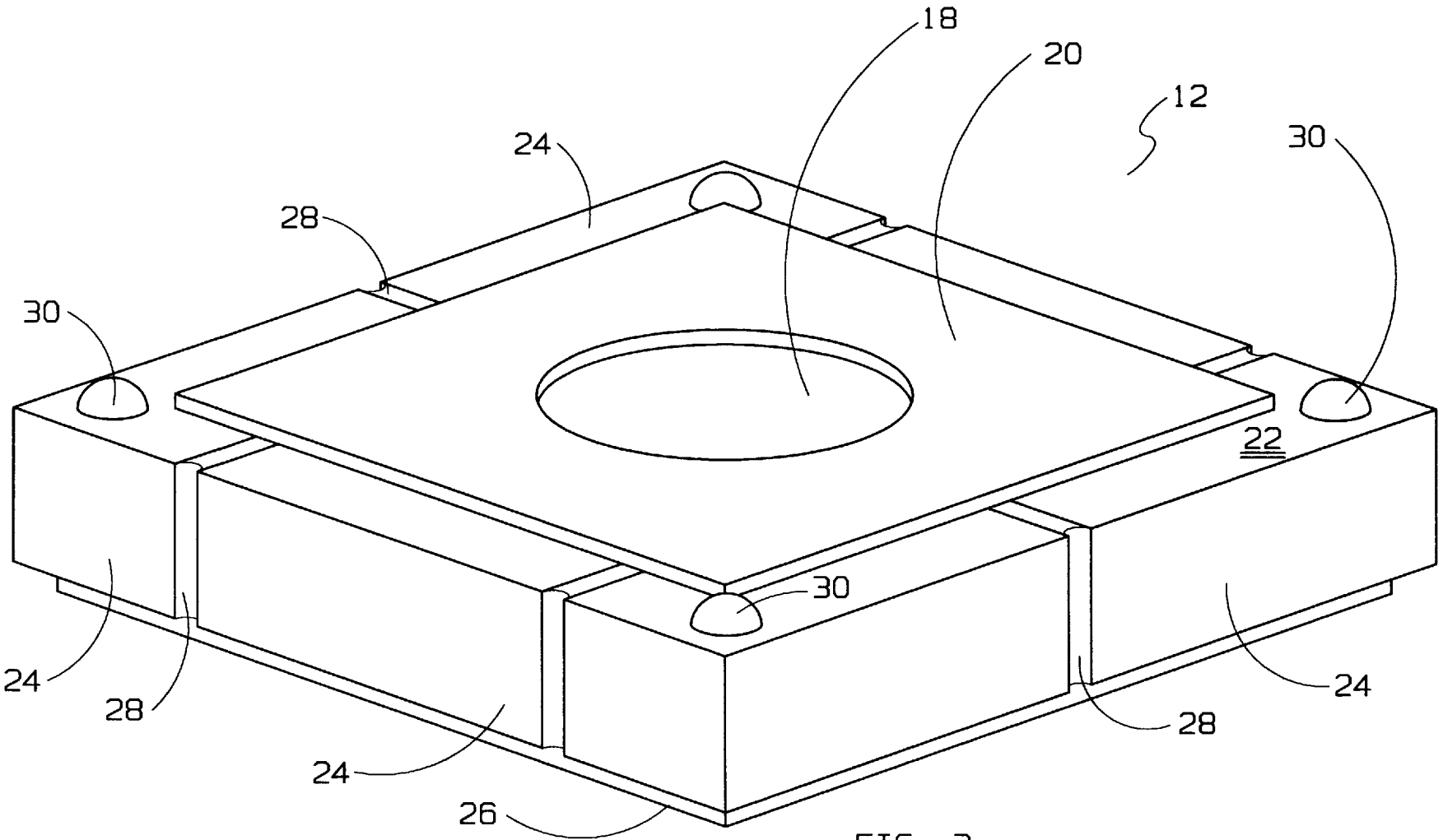
FIG. 3 is, in perspective view, a single layer of the modular pillar of FIG. 1.

As seen in FIG. 1, the modular pillar 10 is a brick pillar having prefabricated brick layers 12 seen better in FIGS. 2 and 3 that duplicate the craftsmanship of a professional bricklayer. It may be built by an unqualified person at a fraction of the cost of traditional brick pillar construction methods, and may be used in the same locations as a traditional pillar, that is, in driveways and fences.

Concrete base 14 is made up of two parts; a precast patio block 14*a* and a precast concrete pillar base 14*b*. Concrete patio block 14*a* acts as the footing for the pillar. Pillar base 14*b* may then be mounted onto the patio block.

Where interior reinforcing is desired, a PVC pipe 16, which may be of 1 inch diameter, is mounted vertically in the center of the precast concrete pillar base 14*b*.

The brick body of modular pillar 10 is made up of a plurality of brick layers 12. These layers may be made of standard fired clay bricks and concrete. Each layer is shaped like a square doughnut. Where interior reinforcing is accomplished by PVC pipe 16, each successive layer 12 is stacked over PVC pipe 16 so as to journal pipe 16 through cavity 18. Each layer 12 interlocks with the previous layer so as to vertically align and strengthen the pillar. Layers 12 interlock by means of raised male mating elevation 20, raised above upper surface 22, into snug mating engagement with a correspondingly-sized depression 21 (shown in dotted outline within mortar simulating layer 26 in FIG. 4 and formed by form 25 seen in FIG. 12) in the underside of the layer 12, that is, in the side opposite upper surface 22.

Figure 12:
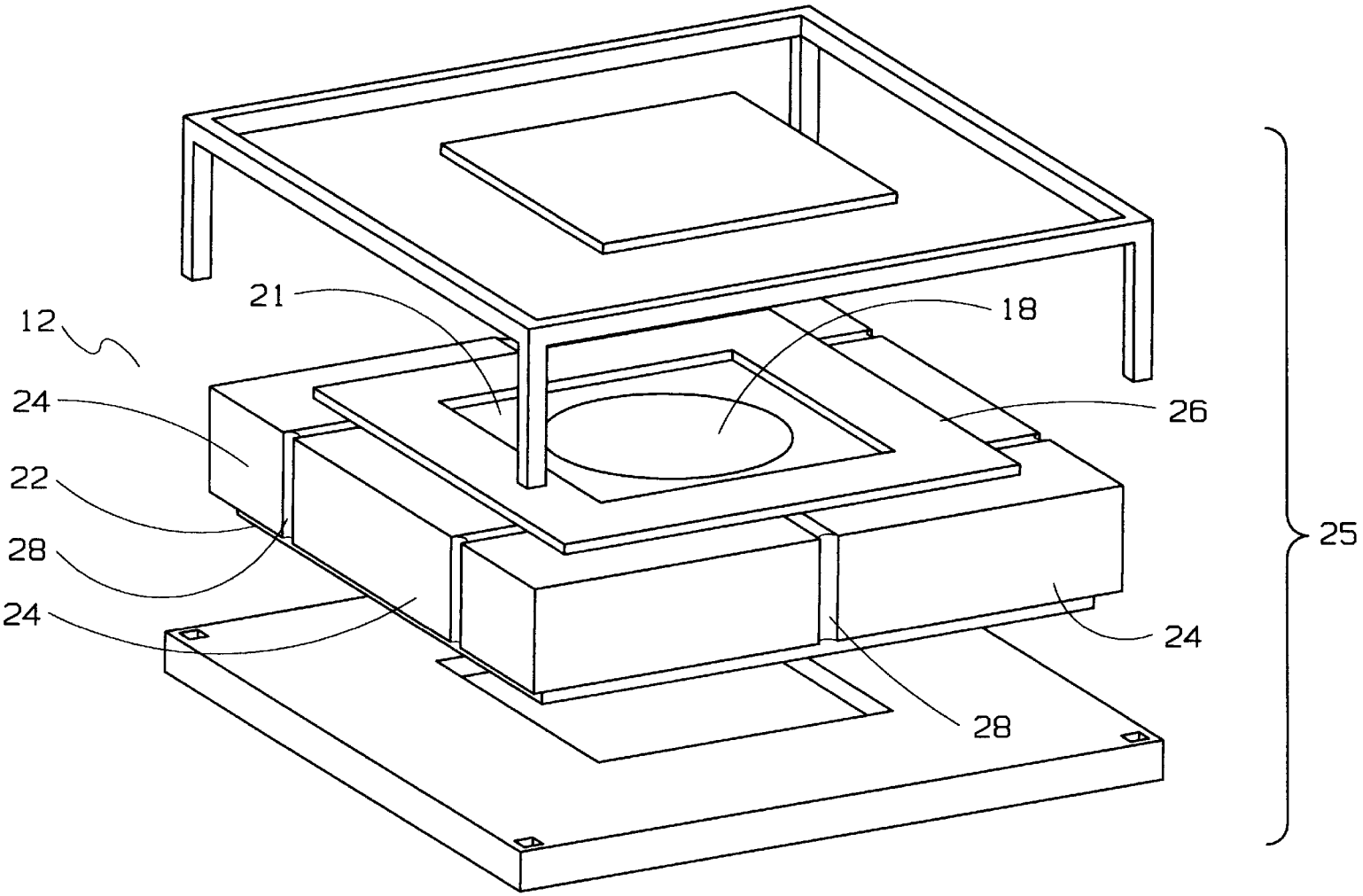
FIG. 12 is the simulated brick layer of FIG. 3 inverted within, in exploded view, a form.

In forming or casting layer 12, in one preferred method of manufacture, individual bricks 24 are laid into a form such as seen in FIG. 12, slightly spaced apart within the form so that when concrete is poured, so as to form mortar simulating layer 26 and male mating elevation 20, the spaces between bricks 24 are also filled so as to simulate vertically oriented mortar 28. In FIG. 12, layer 12 is shown being formed upside-down, that is, inverted relative to the depiction of layer 12 in, for example, FIG. 3. It is understood that cavity 18 would be formed using a vertically disposed tube when the concrete is being poured as would be known to one skilled in the art.

Figure 4:
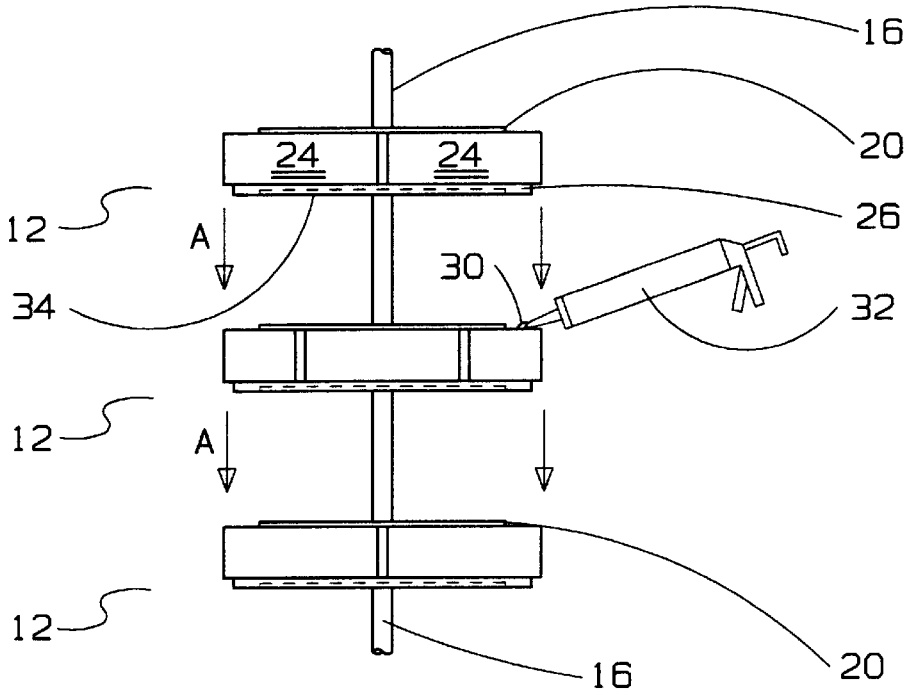
FIG. 4 is, in exploded view, three layers of the modular pillar of FIG. 1, showing an alternative embodiment, wherein a pipe is centrally journalled therethrough.
Figure 5:
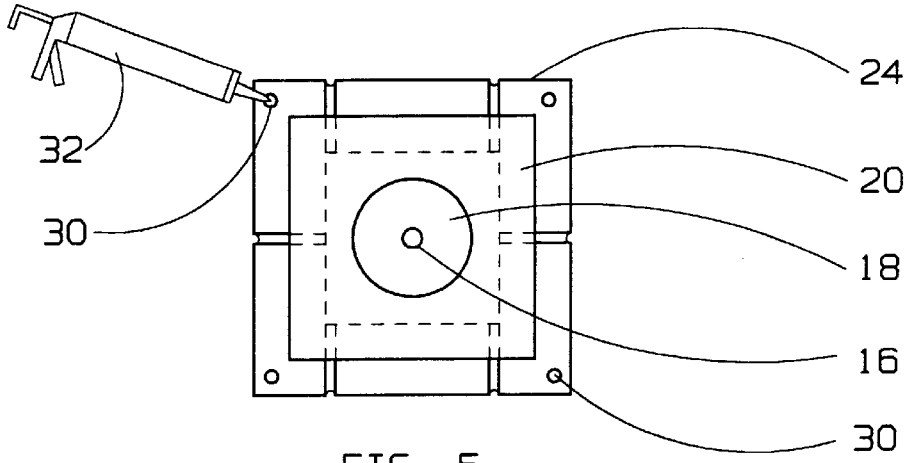
FIG. 5 is, in plan view, the layer of FIG. 3.

As may be seen in FIGS. 2, 4 and 5, caulking is advantageously applied between layers 12 for example by means of caulking dabs 30 applied by means of caulking guns 32 at each upper corner of layer 12, for example, at the corners of male mating elevation 20. Thus as successive layers 12 are laid in direction A so as to assemble pillar 10, caulking dabs 30 spread under the weight of each successive layer to thereby improve adhesion between successive layers. Once layers 12 have been stacked so as to form pillar 10, further caulking may be applied to the horizontal joint lines so as to provide waterproofing of pillar 10.

Figure 6:
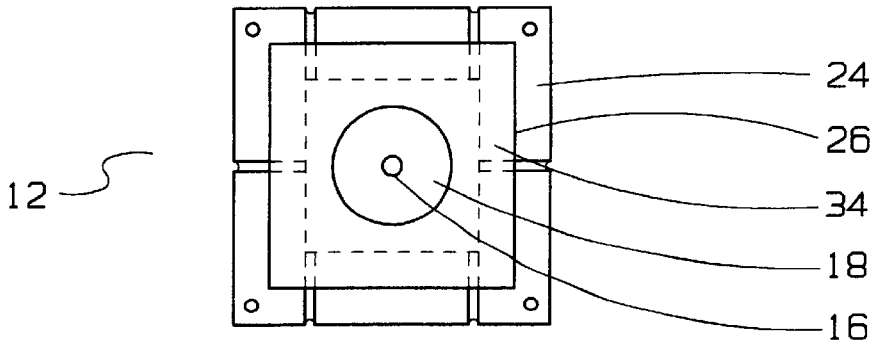
FIG. 6 is, in bottom view, the layer of FIG. 3.
Figure 7:
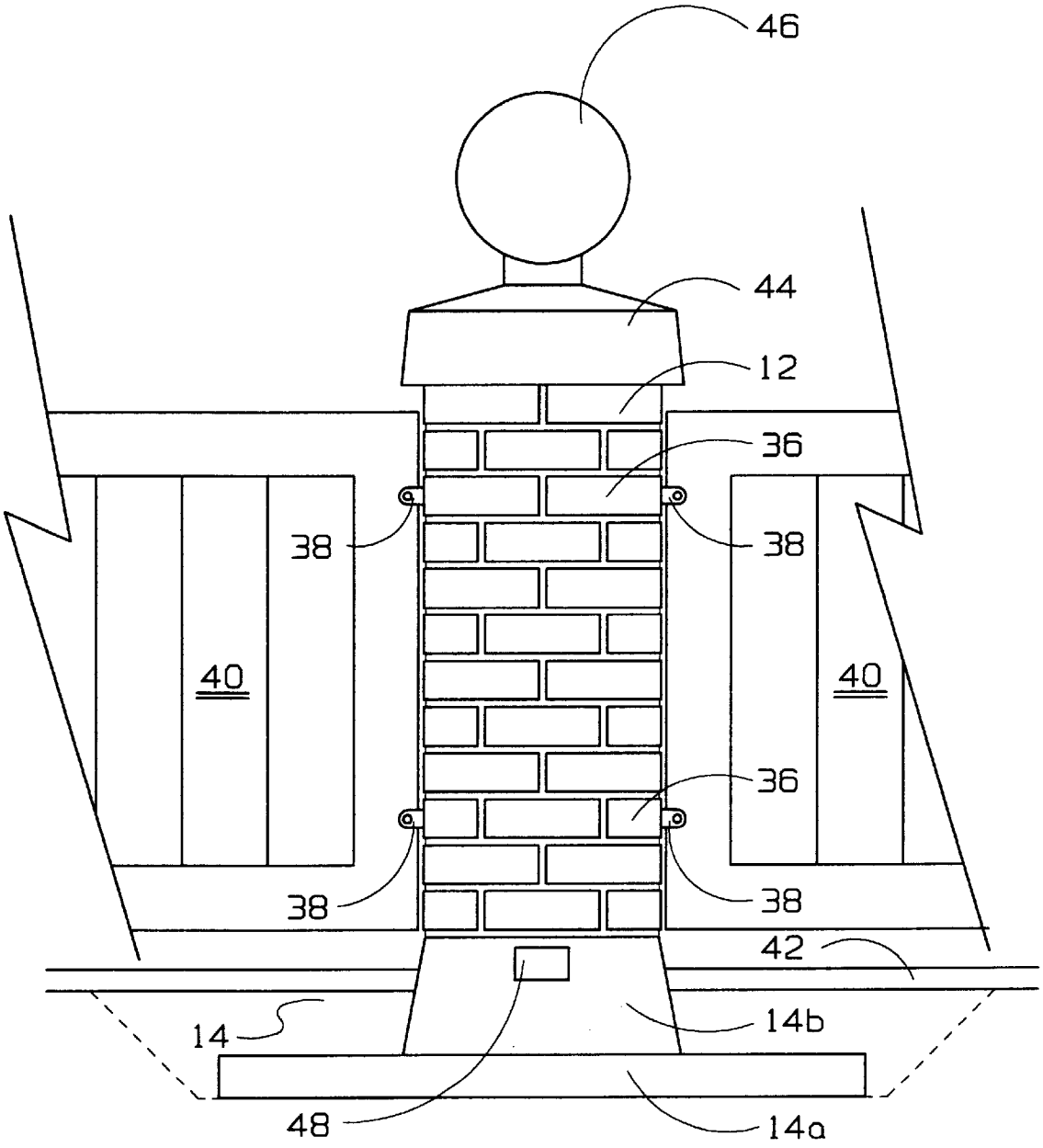
FIG. 7 is, in side elevation view, an alternative embodiment of the modular pillar of FIG. 1.
Figure 8:
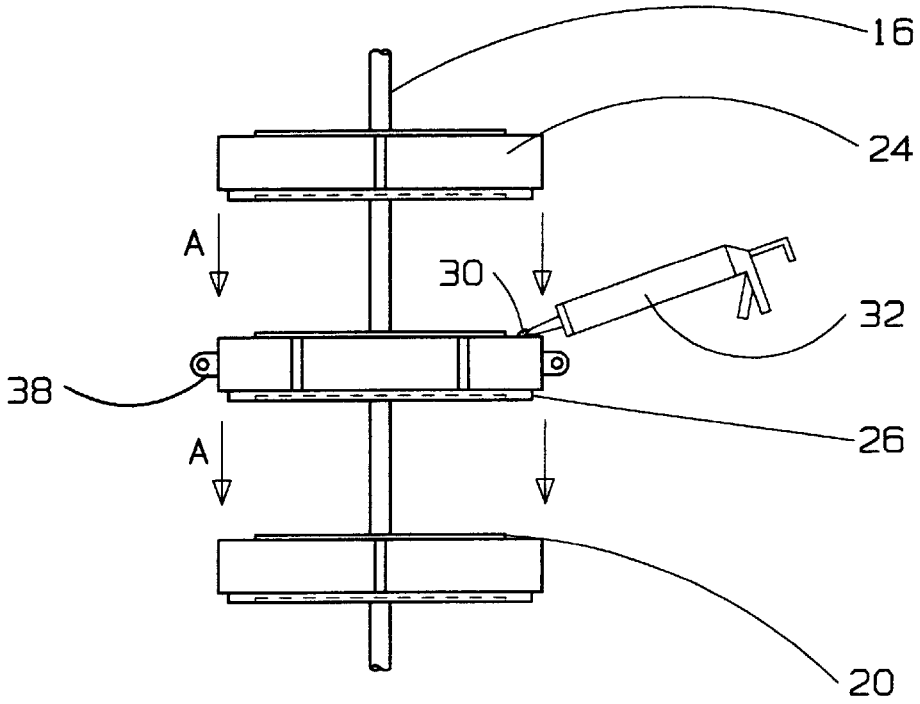
FIG. 8 is, in side elevation exploded view, three layers of the alternative embodiment of FIG. 7.
Figure 9:
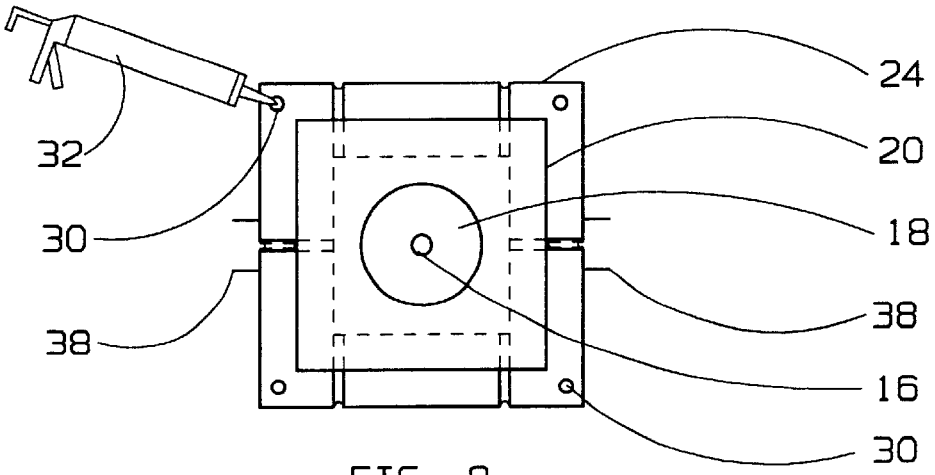
FIG. 9 is, in plan view, a single fence supporting layer of the alternative embodiment of FIG. 7.
Figure 10:
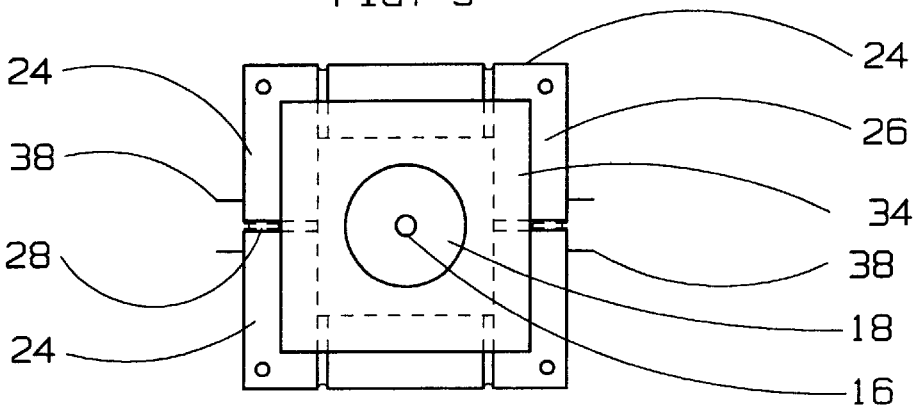
FIG. 10 is, in bottom view, the layer of FIG. 9.

Advantageously, bricks 24 being of the standard size, clay brick type are 2 ⅝ inches deep and, when formed into layer 12, provide a square having 1 foot, 4 inches width on each side. Further advantageously, mortar simulating layer 26 may be one half inch deep so as to provide, for example, a ¼ inch depression 34, as best seen in FIG. 6, for snug mating with a corresponding ¼ inch elevated male mating elevation 20.

As seen in FIGS. 7–10, in a fence pillar application two of the layers 12 (fencing layers 36) have metal bracket attachments 38 for the fence 40. As may be seen, bracket attachments 38 may be formed into fencing layer 36 between bricks 24 within vertically oriented mortar 28. While stacking the layers, if reinforcement is desired, for example, for load bearing columns or heavy fences, in two-foot increments pour concrete into the center cavity 18 of the pillar, between the PVC pipe 16 and the bricks 24. A significant load may then be supported by pillar 10, once reinforced, especially if concrete base 14 has been installed as illustrated, that is, partially below finished grade 42. Advantageously, concrete pillar base 14*b* may be 8 inches in height and rest in an interlocking fashion, similar to the interlocking means between adjacent layers 12, on a 30 inch by 30 inch by 2 inch precast concrete patio block 14*a*.

The pillar is finished off with a concrete cap 44. The concrete cap is precast and designed to interlock on top of the uppermost brick layer 12. A hole is provided in the middle of concrete cap 44 to accommodate PVC pipe 16 if a light fixture 46 is to be installed. If no light fixture is to be installed, cap 44 is solid and PVC pipe 16 is not exposed.

If pillar 10 is to have electrical hook-ups such as exterior plugs and light 46, then precast concrete base 14*b* will have a cast-in-place electrical junction box 48 to accommodate the electrical outlets on the pillar.

Figure 11:
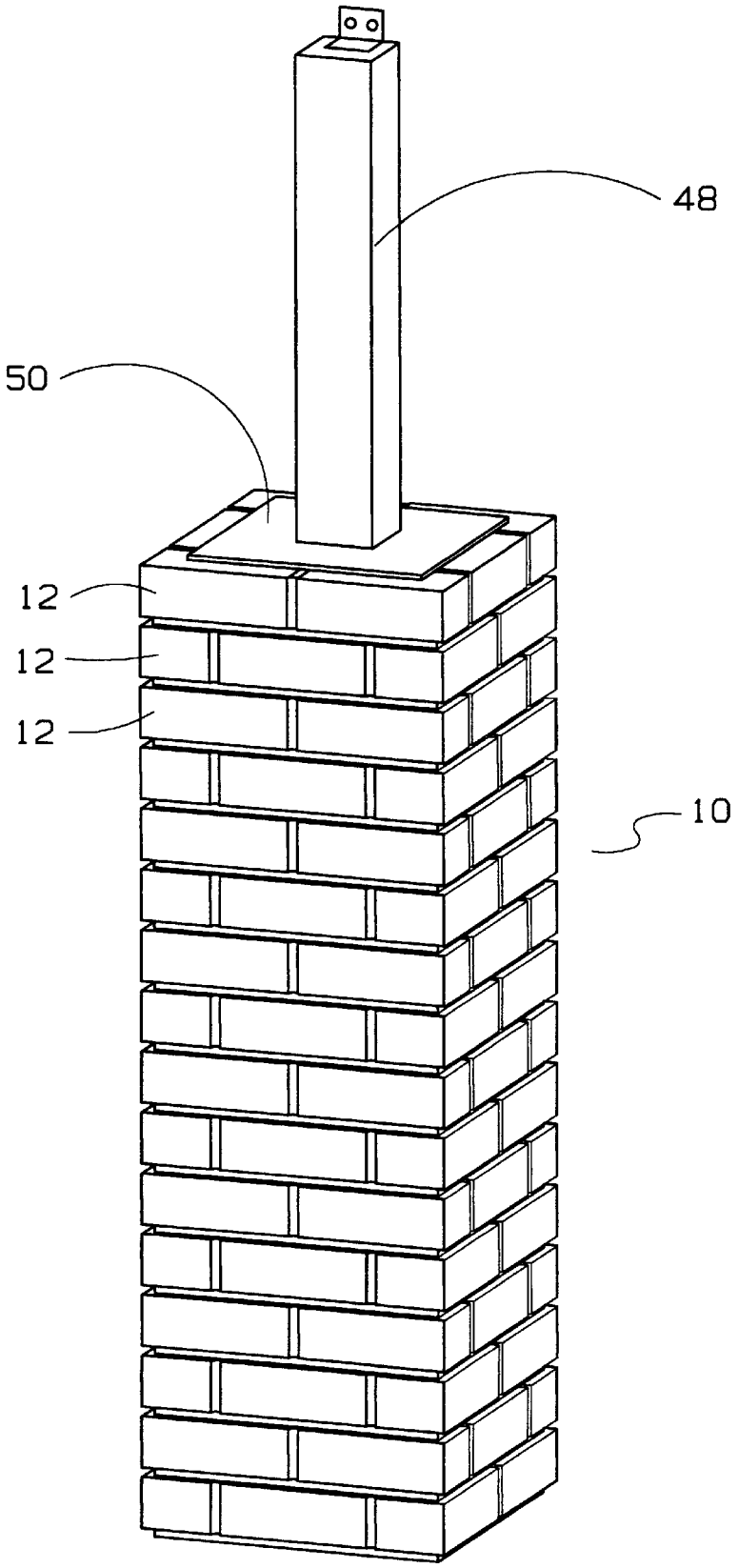
FIG. 11 is, in perspective view, an alternative embodiment of the modular pillar of FIG. 1.

As seen in FIG. 11, pillar 10 of the present invention may be employed to fireproof steel columns 48, such as those found in commercial buildings. In particular, steel columns 48 may be journalled through center cavity 18 and then mortared into place within cavity 18 by means of mortar fill 50.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A modular pillar comprising:

a base module having an upper generally planar surface for receiving in interlocking engagement thereon a simulated brick layer, a plurality of said stimulated brick layers stackable on top of each other in a vertically adjacent array, a lowermost simulated brick layer of said plurality of said simulated brick layers stackable in said interlocking engagement on said upper generally planar surface of said base module, a cap module stackable on top of an uppermost simulated brick layer of said plurality of said simulated brick layers, wherein each of said simulated brick layers has only a single layer of bricks, and wherein each of said simulated brick layers has an outer surface comprising an outer circumferential array of brick surfaces, corresponding to said bricks in said single layer of bricks, extending in a horizontal plane so as to expose radially outwardly of said simulated brick layer at least one face of each of said bricks, said bricks spaced apart in said array to form vertical mortar spaces therebetween, said vertical mortar spaces are filled with mortar to thereby form a circumferentially contiguously extending brick and mortar surface in said horizontal plane around said outer surface of said simulated brick layer, and wherein, when said plurality of said simulated brick layers stackable on top of each other in said vertically adjacent array are so stacked, said horizontal planes of each of said simulated brick layers are parallel, and wherein each of said simulated brick layers define therein a vertically extending cavity extending between a lower aperture in a lower surface of each of said simulated brick layers and an upper aperture in an upper surface of each of said simulated brick layers so as to define a generally vertical columnar cavity extending from said base module to said cap module when said plurality of said simulated brick layers are stacked in said vertically adjacent array, and wherein said simulated brick layers include interlocking means for interlocking said upper surfaces and said lower surfaces on adjacent said simulated brick layers in said plurality of said simulated brick layers.

2. The modular pillar of claim 1 wherein said interlocking means comprises a raised male mating elevation of mortar on said upper surfaces, generally centrally disposed thereon and spanning an area greater than said upper aperture, and a correspondingly sized and correspondingly located depression formed in mortar in said lower surfaces for snug mating of said elevation into said depression when said simulated brick layers are stacked into said vertically adjacent array.

3. The modular pillar of claim 1 wherein said interlocking means comprises a raised male mating elevation of mortar protruding from said lower surfaces, generally centrally disposed thereon and spanning an area greater than said lower aperture and a correspondingly sized and correspondingly located depression formed in mortar in said upper surfaces for snug mating of said elevation into said depression when said simulated brick layers are stacked into said vertically adjacent array.

4. The modular pillar of claim 1 wherein at least one of said simulated brick layers further comprises fence attaching means rigidly mounted thereto.

5. A method of making a modular pillar having a base module having an upper generally planar surface for receiving in interlocking engagement thereon a simulated brick layer, a plurality of said simulated brick layers stackable on top of each other in a vertically adjacent array, a lowermost simulated brick layer of said plurality of said simulated brick layers stackable in said interlocking engagement on said upper generally planar surface of said base module, a cap module stackable on top of an uppermost simulated brick layer of said plurality of said simulated brick layers, wherein each of said simulated brick layers has only a single layer of bricks, and wherein each of said simulated brick layers has an outer surface comprising an outer circumferential array of brick surfaces, corresponding to said bricks in said single layer of bricks, extending in a horizontal plane so as to expose radially outwardly of said simulated brick layer at least one face of said bricks, said bricks spaced apart in said array to form vertical mortar spaces therebetween, said vertical mortar spaces are filled with mortar to thereby form a circumferentially contiguously extending brick and mortar surface in said horizontal plane around said outer surface of said simulated brick layer, and wherein when said plurality of said simulated brick layers stackable on top of each other in said vertically adjacent array are so stacked, said horizontal planes of each of said simulated brick layers are parallel, and wherein each of said simulated brick layers define therein a vertically extending cavity extending between an aperture in a lower surface of each of said simulated brick layers and an upper surface of each of said simulated brick layers so as to define a generally vertical columnar cavity extending from said base module to said cap module when said plurality of said simulated brick layers are stacked in said vertically adjacent array, and wherein said simulated brick layers include interlocking means for interlocking said upper surfaces and said lower surfaces on adjacent said simulated brick layers in said plurality of said simulated brick layers, comprising the steps of:

(a) forming each layer of said simulated brick layers by:

(i) spacing a plurality of bricks into a single layer in spaced circumferential array around an interior circumference of a form, (ii) filling spacing between said spaced array with solidifiable filler, (iii) forming said interlocking means, and, in particular, forming from said solidifiable filler on opposite horizontal surfaces of each of said layers a generally centrally disposed raised male mating elevation spanning an area greater than said aperture and a correspondingly sized and correspondingly located depression respectively corresponding in size and location to said elevation;

(b) stacking successive layers of said simulated brick layers onto said base module into said vertically adjacent array so as to interlock adjacent layers by interlocking said elevation on one simulated brick layer with said depression on an adjacent simulated brick layer; and (c) stacking said cap module onto said uppermost simulated brick layer.

6. The method of claim 5 further comprising the step of journalling a rigid electrical conduit along the length of said cavity for electrical communication of a power supply to an electrical fixture mounted to said modular pillar.

7. The method of claim 6 further comprising the step of filling said cavity with solidifiable filler so as to rigidly mount said electrical conduit in said cavity.

8. The method of claim 5 further comprising the step of applying caulking between adjacent said simulated brick layers.

9. The method of claim 5 further comprising the step of providing fence attaching means mounted to at least one of said simulated brick layers.

* * * * *